US008307671B2

(12) United States Patent
Jungerhans

(10) Patent No.: US 8,307,671 B2
(45) Date of Patent: Nov. 13, 2012

(54) PURIFICATION OF GASES IN SYNTHESIS GAS PRODUCTION PROCESS

(76) Inventor: Robert R. J. Jungerhans, Pasadena, CA (US)

( * ) Notice: Subject to any disclaimer, the term of this patent is extended or adjusted under 35 U.S.C. 154(b) by 0 days.

(21) Appl. No.: 12/657,015

(22) Filed: Jan. 11, 2010

(65) Prior Publication Data

US 2010/0115991 A1 May 13, 2010

Related U.S. Application Data

(63) Continuation-in-part of application No. 12/586,350, filed on Sep. 22, 2009, now abandoned.

(60) Provisional application No. 61/192,556, filed on Sep. 22, 2008.

(51) Int. Cl.
*B01D 3/14* (2006.01)
*C01C 1/04* (2006.01)

(52) U.S. Cl. ..... 62/630; 423/359

(58) Field of Classification Search ..... 62/618, 62/620, 623, 630; 95/228, 288; 203/74, 203/75, DIG. 9; 202/172, 173
See application file for complete search history.

(56) References Cited

U.S. PATENT DOCUMENTS 4,524,056 A * 6/1985 Banquy ..... 423/359
4,588,427 A * 5/1986 Yao et al. ..... 62/634
6,166,051 A * 12/2000 Pellacini et al. ..... 514/357
6,620,399 B1 * 9/2003 Jungerhans ..... 423/359

FOREIGN PATENT DOCUMENTS

GB 2073863 A * 10/1981

* cited by examiner

*Primary Examiner* — Allen Flanigan
(74) *Attorney, Agent, or Firm* — William W. Haefliger

(57) ABSTRACT

A modified purifier process, includes supplying a first stream of a feed gas containing hydrogen and nitrogen in a mol ratio of about 2:1, and also containing methane and argon, then cryogenically separating the feed gas into the following:

f) a second stream of synthesis gas containing hydrogen and nitrogen in a mol ratio of about 3:1, g) waste gas containing principally nitrogen, and also containing some hydrogen and all of the methane supplied in the first stream, and splitting the waste gas into:

h) a third stream of hydrogen/nitrogen gas i) a fourth stream of high concentrated nitrogen j) a fifth stream of methane rich gas, to be used as fuel.

The combined second and third streams typically are passed to an ammonia synthesis process.

11 Claims, 3 Drawing Sheets

SYNTHESIS GAS
N2 RICH GAS
CH4 RICH GAS
FEED GAS
C1
C2
C3
C4
P4
P5
T1
T2,P1
T3
T6,P2
T10,P3
110
111
112
112c
113
114
115
115a
116
117
119
121
122
123
125
126
126a
130
131
131b
132
133
134
135
140
142
143
145
145a
146
150a
150b
152
153
154
155
156
157
158
159
160
110a
110b
112a
113a
114a

SYNTHESIS GAS
N2 RICH GAS
METHANE
RICH GAS
FEED GAS
C1
C2
C3
P3, T10
P2, T6
P4
P5
T5
T9
T8
T7
T4
T1
T2
T11
T13
110
110a
112
112a
112c
113
113a
114
114a
116
117
119
121
122
123
125
126
126a
130
131
132
133
134
135
140
142
143
145
146
146a
150a
150b
151
152
153
154
155
156
157
158
159
160
180
211

PURIFICATION OF GASES IN SYNTHESIS GAS PRODUCTION PROCESS

This application is a continuation-in-part of U.S. application Ser. No. 12/586,350, filed Sep. 22, 2009, now abandoned which is a regular application converted from Provisional application Ser. No. 61/192,556, filed Sep. 22, 2008.

BACKGROUND OF THE INVENTION

The invention relates generally to purification of feed gas used for the manufacture of ammonia, and more particularly to improvements in processing of feed gas from which hydrogen rich ammonia synthesis gas and waste gas are derived. The invention specifically concerns treatment of the waste gas to derive useful gas streams, one of which is hydrogen/nitrogen rich, another is nitrogen rich, and another is methane rich. In the prior Purifier Process synthesis gas is separated from the waste gas, which contains excess nitrogen from the feed gas, a small amount of hydrogen, all of the incoming methane and about 60% of the incoming argon. Such waste gas is typically utilized as fuel in a primary reformer.

U.S. Pat. No. 3,442,613 to Grotz describes a process generally known as the Purifier Process, and specifically towards the cryogenic separation process, also known as the cold box, from which synthesis gas for ammonia production is derived. The present invention particularly modifies and improves the coldbox.

Improvements in treatment of the waste gas are needed for enhanced overall process efficiency.

SUMMARY OF THE INVENTION

It is a major object of the invention to provide improvements in treatment of such waste gas, as will be seen. Basically, the improved process of the invention derives three product streams from the waste gas, one of which is hydrogen/nitrogen rich, another is basically nitrogen rich, and another which is methane rich, with a higher heating value than in the Purifier Process employed so far, more suitable for use as a fuel, with less nitrogen going up the stack and eventually full recovery of hydrogen. The overall process includes the steps:

1) supplying a first stream of a feed gas containing hydrogen and nitrogen in a MOL ratio of about 2/1, and also containing methane and argon,
2) cryogenically separating the feed into the following:
   a) a second stream of a synthesis gas containing hydrogen and nitrogen in a MOL ratio of about 3/1,
   b) waste gas containing principally nitrogen, and also containing substantially all of the methane supplied in the first stream,
3) and splitting the waste gas into:
   c) a third stream of hydrogen/nitrogen gas,
   d) a fourth stream of highly concentrated nitrogen,
   e) a fifth stream of methane rich gas, useful as fuel.

In that overall process, the second, third, fourth and fifth streams are typically delivered as product streams; and the second plus third product streams of synthesis gas may be advantageously delivered to an ammonia synthesis process.

Another object is to provide the split into a third, fourth and fifth streams, through cryogenic separation in such manner that a) the amount of hydrogen of the third stream equals the hydrogen content of the waste gas
b) the amount of methane of the fifth stream equals the methane of the waste gas.

Accordingly, the prior Purifier Process is modified and improved through these measures, in that a) all incoming hydrogen is completely recovered towards synthesis gas
b) the heating value of the methane rich gas is increased, typically from about 180 BTU/SCF (LHV) to about 650 BTU/SCF (LHV).

The methane rich gas is used as fuel and increased heating value improves the combustion.

These and other objects and advantages of the invention, as well as the details of an illustrative embodiment, will be more fully understood from the following specification and drawings, in which:

DRAWING DESCRIPTION

DETAILED DESCRIPTION

Figure 1:
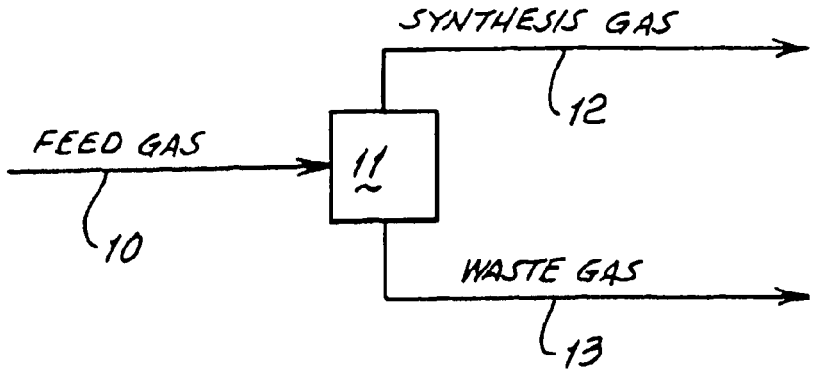
FIG. 1 is a diagram showing the separation of a feed gas into synthesis gas and waste gas as in the Purifier process.

The prior Purifier Process as represented FIG. 1, Feed gas, such as hydrogen, nitrogen, argon and methane is fed at 10 to a cryogenic separation process, also known as, the coldbox 11. The feed gas typically has a hydrogen/nitrogen ratio of about 2. Separated hydrogen is fed at 12 (in a stream with a hydrogen/nitrogen ratio of about 3 from the process 11, and delivered as synthesis gas to the synthesis loop producing ammonia. Separated Waste gas is fed at 13 from the process 11, and contains nitrogen, methane, and about 60% if the incoming argon at 10, usable as a low grade fuel for combustion in the primary reformer. The typical heating value of the waste gas 13 is approximately 160 BTU/SCF (LHV).

Figure 2:
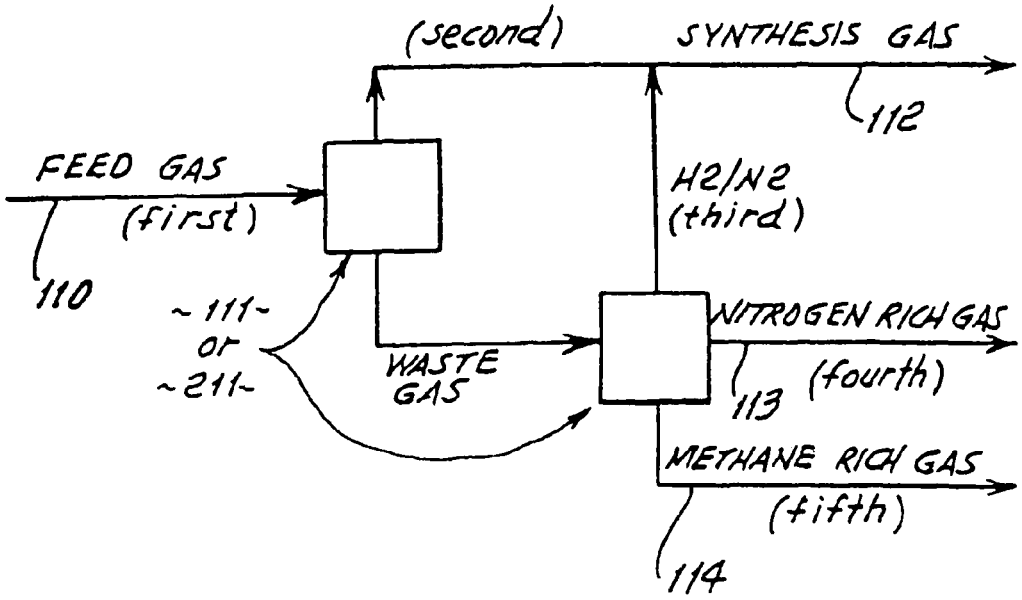
FIG. 2 is a diagram showing the additional split of the waste gas into hydrogen/nitrogen gas, nitrogen rich gas and methane rich gas.
Figure 3:
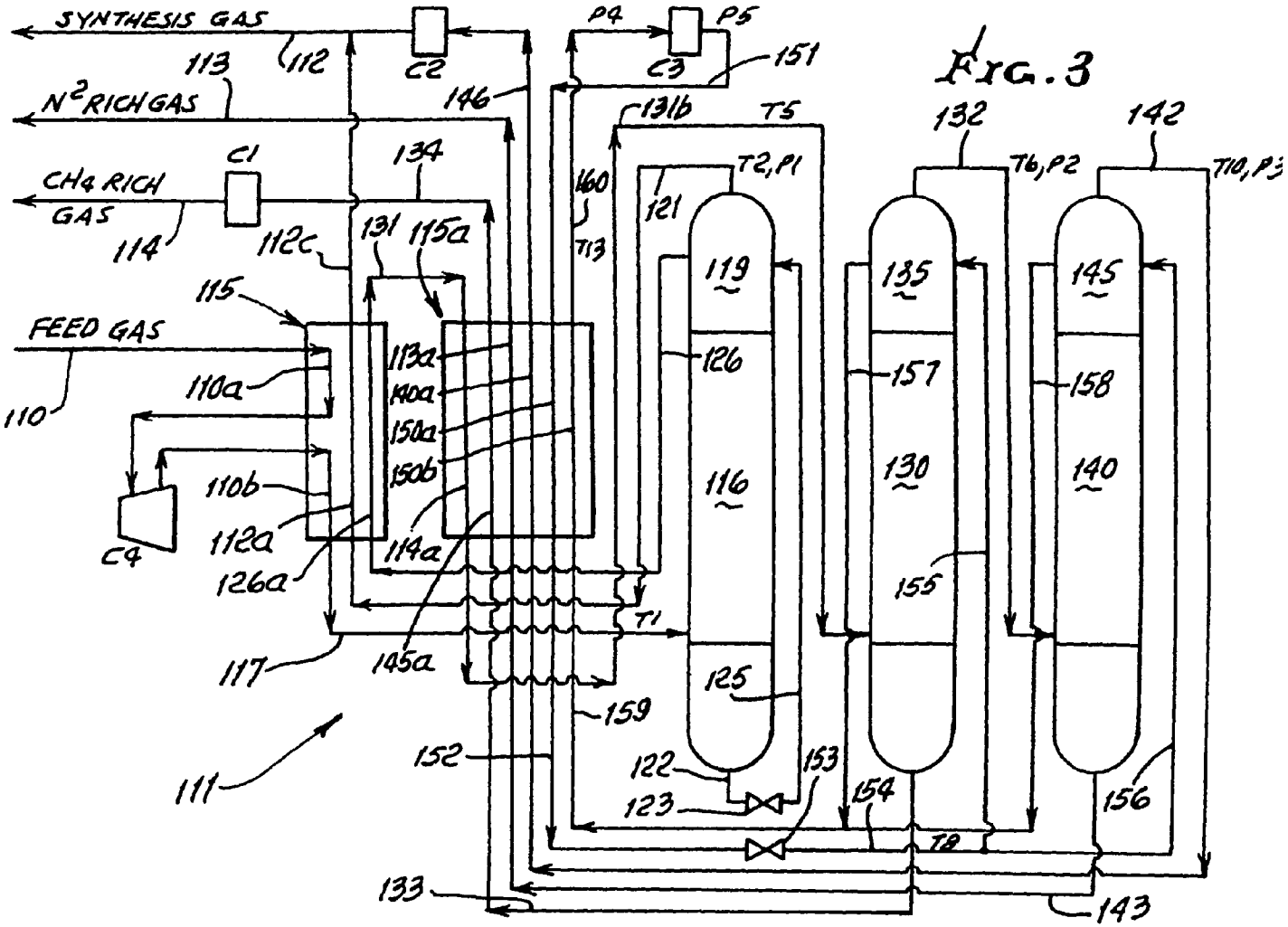
FIGS. 3 and 4 show detailed processes.
Figure 4:
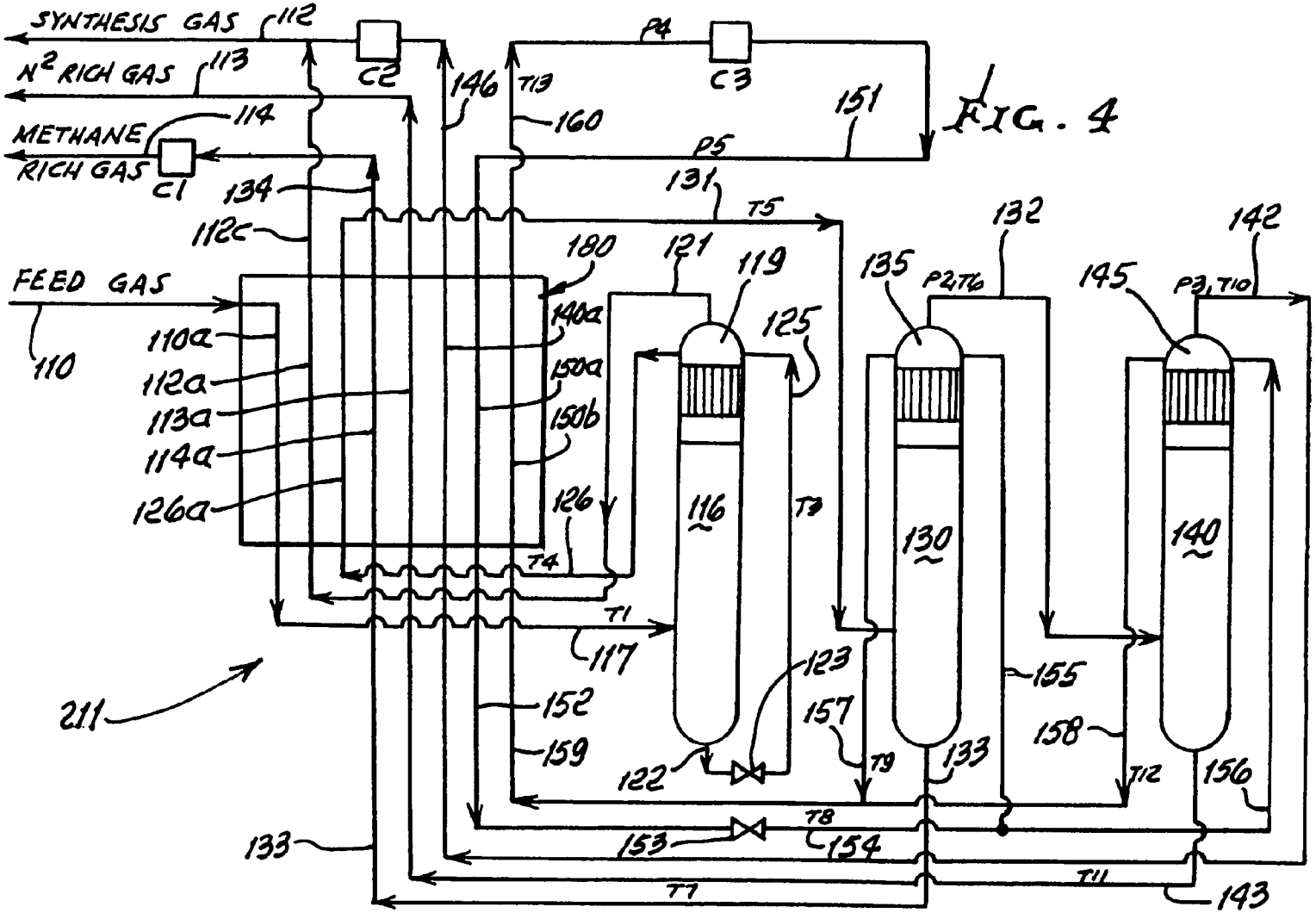

In a preferred and improved prior Purifier Process as represented in FIG. 2 and in more detail in FIG. 3 and FIG. 4 Feed gas is delivered at 110 to a cryogenic separation process indicated generally at 111 or 211. Synthesis gas is withdrawn from the process at 112. Nitrogen rich gas and methane rich gas are separated in the process and delivered as streams 113 and 114 respectively. The methane rich gas 114 is typically used as a (high grade) fuel in the primary reformer.

Referring in detail to process 111 in FIG. 3 heat exchanger 115*a* and columns 130 and 140 are additions to an existing heat exchanger 115 with an existing column 116 at the prior Purifier Process. The streams 110, 112*c* and 131 flow through the existing heat exchanger 115 for heat exchange as shown via coils 110*a*, 110*b*, 112*a* and 126*a*. As in the prior Purifier Process Expander C4 provides refrigeration between coils 110*a* and 110*b*. An existing separation column 116 receives the refrigerated feed via line 117 and synthesis gas is taken from the top of this column and passed through the existing top mounted refluxed condenser 119. Synthesis gas is taken overhead via line 121 and passed to coil 112*a* in the existing heat exchanger 115 for delivery at line 112*c*.

Waste gas is taken from the bottom of the existing column 116 and is passed via line 122 to the existing Joule Thompson valve 123. A typical pressure drop through the JT valve is 300 to 350 psi.

Cooled waste gas then passes via line 125 to provide refrigeration for the existing condenser 119. It passes through line 126 and coil 126*a* in the existing coldbox 115 for delivery via line 131 to coil 114*a* in an additional coldbox 115*a* and exits via line 131*b* as feed to an additional second column 130. Column 130 is provided with a top mounted refluxed condenser 135.

Methane rich gas leaves the bottom of column 130 via line 133 to flow to coil 145*a* in the additional coldbox 115*a* to deliver at line 134. If needed, the pressure of the methane rich gas is boosted in a single stage blower C1 and methane rich gas is delivered at 114.

Overhead gas is taken via line 132 to a third additional column 140. The separation in column 130 is such that all of the incoming hydrogen via line 131*b* but none of the incoming methane via line 131*b* goes overhead via line 132.

The additional third column 140 is provided with a top mounted refluxed condenser 145. Nitrogen rich gas leaves the bottom of column 140 via line 143 to flow to coil 113*a* in the additional coldbox 115*a*, and to deliver at line 113. Nitrogen rich gas (typically $97^{+}$% nitrogen, with the remainder being Argon) may be rejected to the atmosphere.

Overhead gas from the additional column 140 is taken via line 142 to coil 140*a* in the additional coldbox 115*a* to deliver at line 146. The separation in column 140 is such that all of the incoming hydrogen via line 132 goes overhead at column 140. Hydrogen/nitrogen delivered at line 146 is recompressed in compressor C2 and combined with the synthesis gas at line 112*c*, and is delivered at line 112.

Refrigeration for the refluxed condensers 135 and 145 is provided by a refrigeration compressor C3. The discharge of compressor C3 delivers via line 151 to coil 150*a* in the additional cold box 115*a*. The cold refrigerant leaves via line 152 and is expanded via valve 153 to line 154. Refrigerant to refluxed condenser 135 is delivered via line 155; refrigerant to refluxed condenser 145 is delivered via line 156. Refrigerant returns from the refluxed condenser 135 via line 157 and from refluxed condenser 145 via line 158. The combined refrigerant returns via line 159 into coil 150*b* in the additional coldbox 115*a*, and leaves via line 160 to the suction of the refrigerant compressor C3.

Following data are representative for FIG. 3

For a completely new design, per the Purifier Process, the heat exchangers 115 and 115*a* of FIG. 3 can advantageously be combined into one heat exchanger 180, and the Expander C4 can be eliminated, as shown in FIG. 4.

Referring in detail to process 211 in FIG. 4 the streams 110, 112*c*, 113 and 134 flow through a or heat exchanger 180 for heat exchange as shown via coils 110*a*, 112*a*, 113*a* and 114*a*. A first separation column 116 receives the refrigerated feed via line 117 and synthesis gas taken from the top of this column and passed through a top mounted refluxed condenser 119. Synthesis gas is taken overhead via line 121 and passes to coil 112*a* in heat exchanger 180 for delivery at line 112*c*.

Waste gas is taken from the bottom of the column 116 and is passed via line 122 to the Joule Thompson valve 123. A typical pressure drop through the JT valve is 300 to 350 psi.

Cooled waste gas then passes via line 125 to provide refrigeration for the condenser 119. It passes through line 126 and coil 126*a* in the coldbox 180 for delivery via line 131 as feed to a second column 130. Column 130 is provided with a top mounted refluxed condenser 135.

Methane rich gas leaves the bottom of column 130 via line 133 to flow to coil 114*a* in coldbox 180 to deliver at line 134. If needed, the pressure of the methane rich gas is boosted in a single stage blower C1 and methane rich gas is delivered at 114.

Overhead gas is taken via line 132 to a third column 140. The separation in column 130 is such that all of the incoming hydrogen via line 131 but none of the incoming methane via line 131 goes overhead via line 132.

Third column 140 is provided with a top mounted refluxed condenser 145. Nitrogen rich gas leaves the bottom of column 140 via line 143 to flow to coil 113*a* in coldbox 180, and to delivery at line 113. Nitrogen rich gas (typically 97% nitrogen, with the remainder being Argon) may be rejected to the atmosphere.

Overhead gas from column 140 is taken via line 142 to coil 140*a* in heat exchanger 180 to deliver at line 146. The separation in column 140 is such that all of the incoming hydrogen

| | Feedgas | Synthesis gas | | | waste gas | NZ rich gas | CH9 rich gas |
|---|---|---|---|---|---|---|---|
| Stream # | 110 | 112c | 146 | 112 | 131b | 113 | 134 |
| Temp ° F. | 40 | 35 | 35 | 34 | 30 | 35 | 35 |
| pressure psia | 399 | 348 | 40 | 348 | 40 | 15 | 25 |
| Comp. MOL % H2 | 66.1 | 76.2 | 20.5 | 73.8 | 5.5 | — | — |
| Comp. MOL % N2 | 31.0 | 23.6 | 79.5 | 26.0 | 75.5 | 96.8 | 28.9 |
| Comp. MOL % Ar | 0.5 | 0.2 | — | 0.2 | 2.1 | 3.2 | 2.5 |
| Comp. MOL % $CH_4$ | 2.4 | — | — | — | 16.9 | — | 68.6 |
| | 100 | 100 | 100 | 100 | 100 | 100 | 100 |
| LHV BTU/SCF | — | — | — | — | 17- | — | 625 |

Temperatures
T1 = −286° F.
T2 = −295
T5 = −284
T6 = −304
T8 = −325
T10 = −321
T13 = 308
Pressures
P1 = 385 psia
P2 = 22
P3 = 20
P4 = 15
P5 = 172 via line 132 goes overhead at column 140. Hydrogen/nitrogen delivered at line 146 is recompressed in compressor C2 and combined with the synthesis gas at line 112*c*, and is delivered at line 112.

Refrigeration for the refluxed condensers 135 and 145 is provided by a refrigeration compressor C3. The discharge of compressor C3 delivers via line 151 to coil 150*a* in coldbox 180. The cold refrigerant leaves via line 152 and is expanded via valve 153 to line 154. Refrigerant to refluxed condenser 135 is delivered via line 155; refrigerant to refluxed condenser 145 is delivered via line 156. Refrigerant returns from the refluxed condenser 135 via line 157 and from refluxed condenser 145 via line 158. The combined refrigerant returns via line 159 into coil 150*b* in coldbox 180, and leaves via line 160 to the suction of the refrigerant compressor C3.

The following data are representative for FIG. 4.

| | Feed gas | Synthesis gas | | | N2 Rich gas | CH4 Rich gas |
|---|---|---|---|---|---|---|
| stream # | 110 | 112c | 146 | 112 | 113 | 134 |
| Temp. ° F | 38 | 39 | 32 | 38 | 40 | 30 |
| psia | 391 | 379 | 18 | 379 | 17 | 17 |
| comp. mol % H2 | 67.3 | 75.7 | 31.3 | 74.7 | — | — |
| comp. mol % N2 | 29.7 | 24.0 | 68.7 | 25.0 | 97.9 | 22.0 |
| comp. mol % Ar | 0.6 | 0.3 | — | 0.3 | 2.1 | 5.3 |
| comp. mol % CH4 | 2.4 | — | — | — | — | 72.7 |
| | 100 | 100 | 100 | 100 | 100 | 100 |
| LHV BTU/SCF | — | — | — | — | — | 660 |

The presentation of the coldboxes 115, 115*a* and 180 in FIG. 3 and FIG. 4 is schematic and each coldbox is characterized by the following:

1) Heat is exchanged between the flowing process streams, and the temperatures change accordingly as indicated. The heat exchange between the warm and the cold streams is in balance.
2) The heat exchangers and columns are embedded in one common box, providing cold insulation to prevent ingression of heat to the equipment. The insulation side of the cold box interior has one common identical stagnant temperature, for the whole box interior.
3) The presentation in FIG. 3 and FIG. 4 indicates that heat exchange occurs directly between the warm and cold streams, inside the heat exchange device.
4) Accordingly, the cold box interior maintains, throughout the entirety of the gas purification process, the same temperature at which the indicated streams are passed through the cold box interior, after the cryogenic separation.

The parameters, upstream of the coldbox as presented, are to be adjusted as to maintain the feed gas to the coldbox per FIG. 3 and FIG. 4 line 110.

In accordance with the process as described, ammonia production is increased for the same natural gas for feed plus fuel.

I claim:

1. A gas cryogenic separation process, comprising the steps, 1) supplying a first stream of feed gas consisting of hydrogen and nitrogen in a mol ratio of about 2, and also methane and argon,
2) cryogenically separating the feed gas into the following
   a) a second stream of synthesis gas containing hydrogen and nitrogen in a mol ratio of about 3,
   b) a waste gas stream containing principally nitrogen, and also containing substantially all of the methane supplied by the first stream,
3) and employing two columns for splitting the waste gas stream into:
   c) a third stream of hydrogen/nitrogen gas, the amount of hydrogen of the third stream being substantially equal to the hydrogen content of the waste gas,
   d) a fourth stream of nitrogen (97 MOL %) with the remainder substantially being argon,
   e) a fifth stream of methane rich gas the amount of methane of the fifth stream being substantially equal to the methane content of the waste gas stream, useful as fuel,
   f) synthesis gas being provided by compressing said third stream consisting of hydrogen/nitrogen gas and combining with said second stream of gas taken as overhead from a column to which feed gas is initially supplied, and delivering said combined second and third streams of synthesis gas to an ammonia synthesis process,
4) there being coldbox means having at least one common cold interior and wherein said first, second, third, fourth and fifth streams, and said waste gas stream after cooling thereof are passed through said at least one common cold interior or interiors of said coldbox means, said interior or interiors effectively maintaining throughout the entirety of the gas cryogenic separation process at the same temperature said first, second, third, fourth and fifth streams being passed through the coldbox means interior or interiors after said cryogenically separating,
5) and including a first separator column receiving feed gas and operating to separate synthesis gas passed through a first top mounted refluxed condenser, the separated synthesis gas then flowing to and through the coldbox means for delivery as product,
6) there being a waste gas delivery from the bottom of the first separator column, for delivery and flow to a second separator column via
   i) cooling stage whereby the delivery from the cooling stage is passed to said first top mounted refluxed condenser acting as refrigerant therefor,
   ii)and via the coldbox means,
7) and wherein the second separator column is operated to separate methane rich gas leaving the column to flow through the coldbox means for delivery as product methane rich gas,
8) wherein the second separator column is operated to separate substantially all incoming hydrogen delivered substantially free of methane via a second condenser stage at the top of the second column for delivery to a third separator column, said second and third columns being provided columns,
9) wherein the third separator column is operated to deliver synthesis gas via a third condenser stage provided at the column top, the delivered synthesis gas then flowing via the coldbox means as product synthesis gas, and nitrogen rich product gas is delivered from the third column bottom, and via flow through the coldbox means, as product,
10) the herein cryogenic separation process being carried out to effect ammonia production increase in said synthesis process for the same natural gas for feed plus fuel.

2. The process of claim 1 including delivering the combined second and third, fourth and fifth streams as product streams.

3. The process of claim 2 wherein said second, third, fourth and fifth streams are passed in generally parallel relation through the coldbox means.

4. The process of claim 1 including:

i) providing a Joule Thompson valve through which the waste gas stream is passed, to drop the gas pressure and produce refrigeration, and ii) then passing the waste gas to a heat exchanger for cooling of said second stream, iii) and passing the waste gas to said coldbox means.

5. The process of claim 1 that provides:

i) substantially 100% hydrogen recovery of the incoming feed gas towards the synthesis gas, ii) enhanced heating value of the methane rich gas, to be used as fuel.

6. The process of claim 1 wherein said second and third streams are combined and delivered to the same ammonia synthesis process.

7. The process of claim 1 wherein coolant is supplied to flow through said coldbox means, and then through said second and said third provided condenser stages, in a parallel sequence.

8. The process of claim 7 including a coolant supply compressor from which coolant flows through the coldbox means, and then to the two condenser stages, and to which coolant from said condenser stages is returned via the coldbox means, to the compressor.

9. The process of claim 1 wherein said coldbox means comprises an existing coldbox and an added coldbox separate from the existing coldbox.

10. A cryogenic separation process comprising supplying a first stream of a feed gas consisting of hydrogen and nitrogen in a mol ratio of about 2, and also methane and argon, then cryogenically separating the feed gas into the following:

a) a second stream of synthesis gas containing hydrogen and nitrogen in a mol ratio of about 3, b) a waste gas stream containing principally nitrogen, and also containing some hydrogen and substantially all of the methane supplied in the first stream, and splitting the waste gas stream into:

c) a third stream of hydrogen/nitrogen gas, d) a fourth stream of high concentrated nitrogen, e) a fifth stream of methane rich gas, to be used as fuel, and combining the second and third streams and passing the combined second and third streams to an ammonia synthesis process, the herein cryogenic separation process being carried out to effect ammonia production increase in said synthesis process, f)said process employing three cryogenically operated gas separation columns.

11. The process of claim 1, wherein fuel content provided by the waste gas stream is substantially enhanced, for increasing ammonia production.

* * * * *